United States Patent [19]

Fukuma et al.

[11] 4,045,920

[45] Sept. 6, 1977

[54] CAM-CONTROLLED GRINDING MACHINE

[75] Inventors: Nobuo Fukuma, Toyota; Hideyuki Matsubara, Toyoake, both of Japan

[73] Assignee: Toyota Jidosha Kogyo Kabushiki Kaisha, Toyota, Japan

[21] Appl. No.: 744,400

[22] Filed: Nov. 23, 1976

Related U.S. Application Data

[62] Division of Ser. No. 656,076, Feb. 6, 1976, Pat. No. 4,015,372.

[51] Int. Cl.[2] ..... B24B 49/04

[52] U.S. Cl. ..... 51/165.88; 51/165.93

[58] Field of Search ..... 51/105 R, 105 SP, 165 R, 51/165.77, 165.78, 165.79, 165.88, 165.93

[56] References Cited

U.S. PATENT DOCUMENTS

| | | | |
|---|---|---|---|
| 2,704,915 | 3/1955 | Grobey | 51/165.78 X |
| 3,653,855 | 4/1972 | Smith | 51/165.77 |
| 3,777,441 | 12/1973 | Kurimoto | 51/165.77 |

*Primary Examiner*—Harold D. Whitehead
*Attorney, Agent, or Firm*—Browdy and Neimark

[57] ABSTRACT

In the cam-controlled "sizematic" type grinding method and apparatus therefor, a novel "in process" "gagematic" type measuring means has been introduced so as to maintain the strong points of the former and develop a new grinding method and apparatus capable of securing high precision and fine surface finish of workpieces at the same time. For attaining the above purpose (a) a novel process of comparing the timing of signals of reaching the target final dimension and lapsing of the minimum required "spark-out" grind time and (b) a compensation process for wear of the dresser point are introduced.

3 Claims, 8 Drawing Figures

FIG. 2
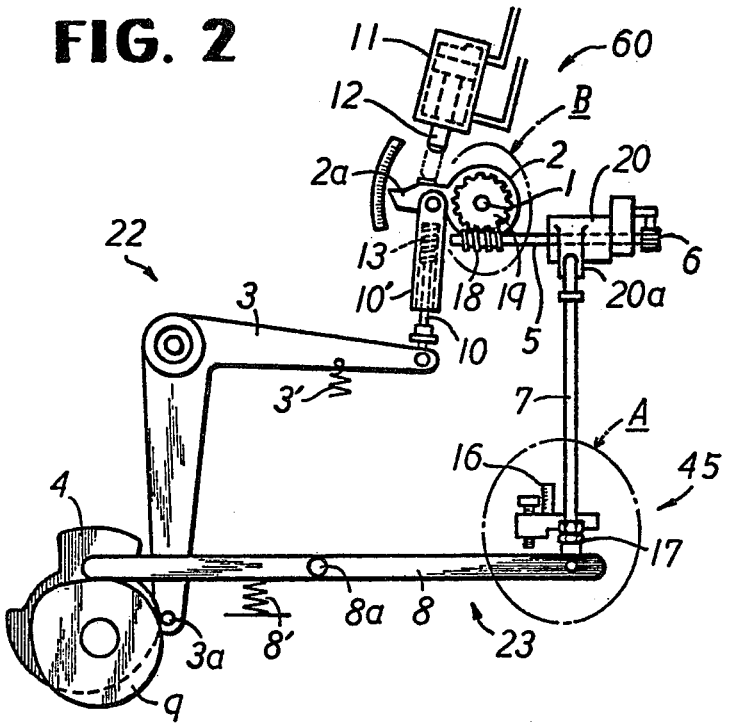
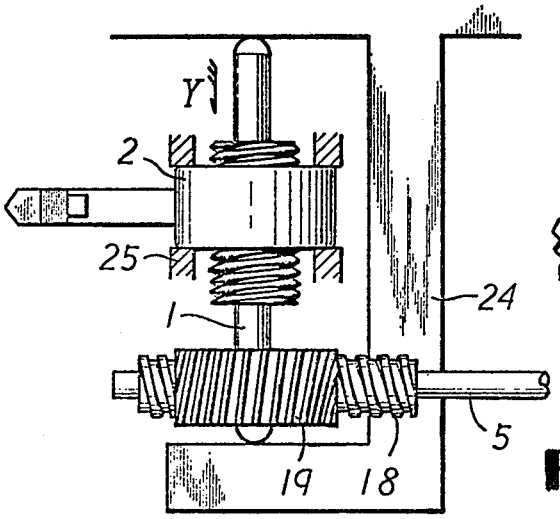
FIG. 2-2
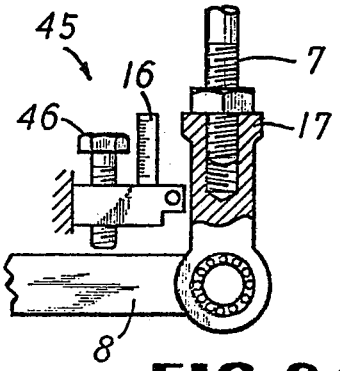
FIG. 2-1

CAM-CONTROLLED GRINDING MACHINE

This is a division of application Ser. No. 656,076, filed Feb. 6, 1976, now U.S. Pat. No. 4,015,372, issued Apr. 5, 1977.

BACKGROUND OF THE INVENTION

The present invention relates to a method of controlling, by means of a cam or cams, relative position between an abrasive wheel (hereinafter simply referred to the wheel) and a workpiece in the grinding process as well as an apparatus therefor, and more particularly, to a method wherein the so-called gagematic system is incorporated into the so-called sizematic systems so as to enjoy both high productivity of the former and high preciseness of the latter, i.e., a method wherein a minimum required spark-out grind necessary for obtaining workpieces having not only target dimension but also fine finish surface can be secured, and an apparatus therefor. This invention pertains at the same time to a method of automatically compensating for wear of a dresser (a tool for dressing a wheel), which is a prerequisite for achievement of the above purpose, and an apparatus therefor.

There have conventionally been two main systems of the grinding process for controlling finish dimension of ground workpieces; the above-mentioned so-called gagematic system and the so-called sizematic system. In the former system, workpieces are finished to a target dimension by actually measuring dimensions during the grinding operation with a final size measuring means and thereby controlling the grinding feed mechanism of the wheel and others. In the latter, workpieces are finished to a desired target dimension by controlling the wheel feed mechanism of the wheel, taking the position of the nose point of a dresser (dresser point) as a reference. In general the sizematic system is characterized in a shorter period of grinding process cycle; the gagematic system is said to be superior in high uniformity and preciseness of the finish dimension. In the cam-controlled grinding process and apparatus therefor, which is the subject matter of this invention, the sizematic system is usually employed. Controlling grinding cycles, including the final size control, by means of a cam or cams makes the control by the final size measuring difficult to be applied, which is the main reason for the employment of the sizematic system.

In the conventional sizematic system not only working wear of the wheel during the grinding but also wear of the wheel by dressing is compensated by means of the compensating means for dressing (means for displacing the chuck means which holds a workpiece as much as the amount of the external diameter reduction of the wheel by another cam system, for example) and attempts have been thereby made to maintain the finish dimension of workpieces constant. No steps have been taken, however, against change of the relative position of the dresser point to the axis of the workpiece, which change is brought about by wear of the dresser itself. Diamond, the hardest material, is used as the dresser point, nevertheless, gradual wear thereof is inevitable, which results in unavoidable variation of the final dimension of workpieces and in turn makes it impossible to continue grinding processes of uniform and high precision.

The cam-controlled grinding machines are mostly used for internal grinding of smaller diameter bores, so the wheel diameter is small. It means the wear rate of the wheel in the grinding is rather great; it is normal, therefore, to carry out dressing of the wheel once per one workpiece (in some cases several times of dressing are done per one workpiece, in some other cases only one dressing is sufficient for several pieces of works). The more the number of frequency of dressing, the larger becomes the wear of the dresser point.

During the spark-out (a phenomenon wherein sparks by grinding cease to come out) time in a grinding cycle on a grinding machine, the abrasive wheel will be still subject to grinding feed, though only slightly, up until deflection of the wheel spindle (as well as workpiece deflection) has disappeared, irrespective of further increase of the grinding feed movement due to the cam profile; thus, final dimension of the workpiece is still subjected to changing. In particular, internal grinding machines for rather small internal diameter bores normally have a wheel spindle of smaller diameter than the diameter of the wheel which is originally small, so the deflection of the wheel spindle due to grinding force will naturally be great, so that restoration of the deflection during the sparkout step is an important factor requiring attention. Considering the merit of remarkably improving the finish surface roughness during the continued grinding period of sparkout, i.e., a certain period of time before sparks have completely been ceased (hereinafter simply referred to as sparkout time) by restoration of deflection of the wheel spindle, the problem is critical that wear of the dresser point (including another problem that increasing of the area of the pointed end of the wheel affects the wheel surface and in turn the surface character of the workpiece) continuously increases dimensions of the workpieces and thereby makes the securing of time, during which fine finish surface by the sparkout grinding is expected, extremely difficult. In the sizematic system compensation for the wheel dressing has been conventionally practiced and uniformity of finish dimension of workpieces has been thereby attained in a way. The continuous tendency of increasing the finish dimension of workpieces due to wear of the dresser point mentioned above has by no means been compensated. The sizematic system is incapable of compensation for variation in the deflection of the wheel spindle in response to changing of the shape of the dresser point, non-uniformity of the wheel, variation in workpiece material, unstable deflection set forth hereinafter, etc., and in turn variation in time-of-deflection-restoration of the wheel spindle in the sparkout time.

Further attention is required to the fact that repeated dressing tends to decrease the wheel diameter, resulting in decrease of the peripheral velocity and increase of resistance for grinding even for a constant rate of feeding which resistance will increase deflection of the spindle and make the deflection inconstant or unstable. In the conventional method, operators have had to check finish dimensions of workpieces, finish surface roughness and manually to adjust on occasion the position of the dresser or others, which largely depends on hunch or experience of the operator and is far from stable production of workpieces of uniform dimension. Diversification of causes thereof has been preventing the solution of the problem.

SUMMARY OF THE INVENTION

The hard problem set forth above has been skillfully solved by the present invention. It has completely obviated the above-mentioned shortcomings inevitable to the cam-controlled method of the sizematic system with its advantages being maintained, and has furthermore succeeded in keeping the final dimensions of workpieces uniform and highly precise, on one hand, by adding a final size measuring means and ending the grinding operation in the sparkout step by means of final size signal issued therefrom, and in keeping the finish surface roughness of workpieces in good condition, on the other hand, by securing the sparkout grinding over a certain period of time.

To sum up, this invention is to provide a novel cam-controlled grinding apparatus which (a) obviates the above-mentioned troubles that have hindered securing of precisely and finely finished workpieces with uniform dimension and (b) enables operators to be relieved of manual knack-necessary adjustment of the dresser point, by securing without fail necessary sparkout grinding for a certain preset period of time before the time of issue of the final size signal which terminates the grinding operation, because otherwise a compensating mechanism for dresser point will operate to secure the sparkout grinding, automatically, if desired.

It is, therefore, a primary object of this invention to provide an improved grinding apparatus by adding an "in process" (to measure dimension while grinding is taking place) final size measuring means of the gagematic type into a cam-controlled grinding apparatus of the sizematic type which is characterized in high speed cycle and high productivity so as to introduce an advantage of the gagematic method of securing the final dimension of workpieces, i.e., precision of finish dimension.

It is another object of this invention to provide an improved grinding cam-controlled grinding apparatus characterized in obtaining products of fine finish surface while maintaining uniform precise finish dimension by means of securing a certain minimum sparkout grinding time required in the grinding process necessary for that purpose.

It is still another object of this invention to provide a apparatus for attaining the above-mentioned purposes, that is to say, for issuing final dimension signal and the minimum sparkout termination signal as well as for comparing and judging the timing of the two signals.

It is still another object of this invention to provide a novel cam-controlled grinding apparatus which includes a dog disposed on the cam and a limit switch on the bed for cooperating to issue sparkout termination signal and final dimension signal in the proper order so as to guarantee the workpieces to be processed to the target dimension and also to fine finish the surface.

It is still another object of this invention to provide a novel cam-controlled grinding apparatus which includes a dog disposed on the cam, a limit switch on the bed, a timer for securing a certain minimum time of sparkout grinding, and a comparison device electrically to judge the timing of two signals so as to guarantee workpieces to be processed to the target final dimension and to fine finish the surface.

It is a further object of this invention to provide a apparatus for performing an automatic compensation of wear of the dresser which is one of the greatest hindrance for securing fine finish surface.

It is still a further important object of this invention to provide devices or apparatuses for improved grinding operation above-mentioned inexpensive to manufacture, simple in construction, and easy in adjustment.

It is still a non-negligible object of this invention to provide a novel grinding apparatus which may be readily applicable to a conventional cam-controlled grinding apparatus by simply adding to same or with easy partial rebuilding.

BRIEF DESCRIPTION OF THE DRAWINGS

For better understanding of the nature of this invention and for further objects, reference should now be made to the following detailed specification and to the accompanying drawings in which:

FIG. 2 is an illustrative view showing the wheel feed mechanism and dresser feed mechanism of this invention, FIG. 2-1 is an enlarged view of A portion of FIG. 2, FIG. 2-2 is an enlarged view of B portion of FIG. 2 seen from a direction which is normal to FIG. 2.

DETAILED DESCRIPTION OF THE PREFERRED EMBODIMENT

Referring to the appended drawings that schematically show the essential parts of an internal grinding machine, a most preferable embodiment of this invention, detailed description thereof will be made hereinafter. Well known matters to those skilled in the art concerning internal grinding machines in general, however, will not be described herein. In this embodiment also an abrasive wheel and a workpiece do relative movements in the axial direction of the workpiece and in a direction normal thereto (in the radial direction). Relative movements in the axial direction, longitudinal movements, comprise a rapid feed of the wheel into a bore of the workpiece when a grinding process is started, longitudinally reciprocal movements which may be neccessitated during the grinding operation depending on a relation between the length of the wheel and the length of the surface to be ground, a quick return of the wheel for dressing executed outside the workpiece bore after completion of the rough grind, dressing feeds, a rapid re-feed of the wheel into the workpiece bore for finish grinding, reciprocal movements during finish grinding, if required, a quick re-return for retracting the wheel to the outside of the workpiece bore after termination of the finish grinding, etc., all these movements, which occur in response to each step of grinding, are familiar to the people in the art.

Figure 1:
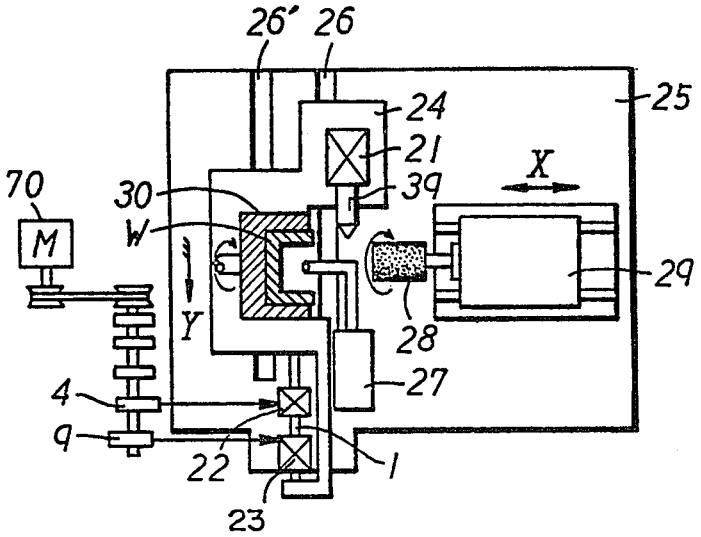
FIG. 1 is a schematic plan view of an essential part of an apparatus employing this invention.

Omitting the longitudinal movements, detailed description will be made only of the relative movements in the radial directions. In FIG. 1, a schematic plan view which shows essentional parts of a grinding machine, a motor 29 for driving a wheel 28 is slidably disposed in the direction of the arrow X on the bed 25 (axial direction of the wheel). On the bed 25 is mounted in confrontation with the wheel 28, through an intermediary of a workhead (not shown) a chuck 30, is disposed rotatably around an axis parallel to the wheel axis, for holding a workpiece W. A carriage 24, on which the chuck 30 is mounted, is engaged with guide means 26, 26' (which may be rods, grooves, surfaces, etc.) and is displaceable in the direction of the arrow Y (in one fixed direction) by means of an (abrasive) wheel feed mechanism 22 to be fed through a feed shaft 1; it is also so arranged as to be retracted in the reverse direction of the arrow Y. A dressing means 21 for dressing the wheel 28 is disposed on the carriage 24 in a manner such that the front end of the dresser confronts the external diameter of the wheel 28. The above-mentioned feed shaft 1 is engaged with the carriage 24 through the intermediary of a feed nut 2 later to be referred to. To the feed shaft 1 are engaged both the wheel feed mechanism 22 controlled by a cam 4 and the dresser feed mechanism 23 controlled by another cam 9; the carriage 24 is, therefore, movable either when the wheel feed mechanism 22 is operated or when the dresser feed mechanism 23 is operated. The workhead and the dressing means 21 are, however, mounted both on the same carriage 24, so the point position of the dresser 39 always lies at a place of a constant distance from the axis of the workpiece W provided that the amount of wear of the pointed-end of the dresser be left out of consideration. Even if the dresser feed mechanism 23 is actuated, i.e., the diameter of the wheel 28 is reduced by the dresser 39 as much as the amount of dressing, the distance between the target dimension surface of the workpiece W (the target dimension means that with no tolerance.) and the external peripheral surface of the wheel 28 after dressing is to be constant at the time dressing is completed; that is to say, the compensation for dressing is automatically carried out by means of the dresser feed mechanism 23. A workpiece W will be ground in this way to a target dimension if only the carriage 24 displaced a fixed amount by means of the wheel feed mechanism 22.

The wheel feed mechanism 22 and dresser feed mechanism 23 are, as shown in FIG. 2, respectively controlled by the cams 4 and 9. Against the wheel feed cam 4 is tightly pressed a roller 3*a*, which is pivoted to one end of a lever 3, by means of a spring 3' for keeping engagement with cam 4; the other end of lever 3 is pivotably connected to a push rod 10, which is fitted into a cylindrical member 10' whose one end is open; a pre-compressed spring 13 is interposed between rod 10 and cylindrical member 10'. When push rod 10 is lowered by means of lever 3, it moves, therefore, in unison with cylindrical member 10'; either when rod 10 rises or cylindrical member 10' is pressed downwardly the movement is transferred through the coil-spring 13. The resisting force of the spring 13 under the pre-compressed state shall be large enough to move the carriage 24 against the frictional resistance and grinding force through the medium of a member later described. One end of the cylindrical member 10' is pivoted to a projection 2*a* of a feed nut 2 which is threadedly engaged with the feed shaft 1; confronting to cylindrical member 10' which is pivoted to the projection 2*a*, is disposed a cylinder 11 on the other side thereof; said cylinder 11 is constructed such that a slidably fitted piston rod 12 therein can be forwarded in response to a signal from a final size measuring means 27 later to be referred to. Owing to the forward motion of piston rod 12 the projection 2*a* of feed nut 2 presses cylindrical member 10' while pressing the spring 13 and thereby rotates feed nut 2 in the reverse direction of the wheel feed direction, and in turn moves feed shaft 1, i.e., moves the carriage 24 for separating the wheel 28 from workpiece W, terminating the grinding operation. In other words, cylinder 11 and piston rod 12 constitute, together with feed nut 2, an operation mechanism 60 for the final dimension.

The dresser feed mechanism 23 is controlled by cam 9 which is coaxial with wheel feed cam 4 and driven by a common driving source, an electric motor 70. One end of lever 8 pivoted at a fulcrum 8*a* is in contacting engagement with dresser feed cam 9 by the tension of a spring 8'; the other end of lever 8 is adjustably connected to one end of a rod 7 through a joint member 17; the other end of rod 7 is oscillably pivoted to an arm 20*a* of an oscillatory member 20, on which are mounted a feed click and a claw clutch 6 for one way function; a dresser feed shaft 5 is secured to oscillatory member 20 coaxially therewith; on one end of shaft 5 is secured worm 18 which is in mesh with a wormwheel 19 fixed to feed shaft 1. Rotative movement of lever 8 due to the actuation of dresser feed cam 9 thus actuates, in turn, rod 7, oscillatory member 20, claw clutch 6, dresser feed shaft 5, worm 18, and wormwheel 19 in the order. Consequently, the feed shaft 1 is rotated, which displaces the carriage 24 accompanied by the advance of the dresser 39. The dresser feed is carried out in this way, and those above-mentioned members construct the dresser feed mechanism 23.

Still on one end of lever 8 is disposed a manually operable dresser feed adjustment means 45 (refer to FIG. 2-1). Although lever 8 is being kept in pressing contact against the dresser feed cam 9 due to the force of spring 8' while being rotationally moved, a bolt 46 for adjusting the amount of the oscillatory stroke of rod 7 to a certain amount less than that of the entire lift of cam 9 is disposed in the vicinity of the other end of lever 8 confronting thereto lever 8 is rotatably connected to joint member 17. While the descending movement of rod 7 in FIG. 2 is forced by the cam 9, the ascending movement thereof is on the contrary limited by the adjusting bolt 46 up to the position where lever 8 hits the same. As a result, rotation angle of dresser feed shaft 5 is to be controlled by the stroke of rod 7.

FIG. 2-2 shows a status of engagement wherein feed nut 2 of the grinding feed mechanism 22 and worm 18 of the dresser feed mechanism 23 are engaged with the feed shaft 1, which shaft being carried by the carriage 24, on both ends thereof with no substantial play in the axial direction; feed nut 2 threadedly engaged with feed shaft 1 is rotatively (rotatable in a small angle) carried by a portion of the bed 25 with both sides thereof and having no clearance in the axial direction; wormwheel 19 is carried by feed shaft 1 and rotatable in unison therewith but axially slidable thereto. Assuming that feed nut 2 is rotated while worm 18 is stationary, feed shaft 1 is not allowed to rotate because wormwheel 19 is engaged with worm 18, consequently it is forced to move in the direction of the arrow Y in FIG. 1 effecting displacement of the carriage 24 in the same direction. Assuming again that worm 18 be rotated while feed nut 2 stops, feed nut 2 will act as a stationary nut (the feed nut will be subject to a large resistance in a counterclockwise rotative movement in FIG. 2 under the influence of resisting force from the pre-compressed spring 13), though it is not allowed to axially move, and feed shaft 1 is moved in the direction of the arrow Y in FIG. 1, eventually moving the carriage 24 (this movement encounters far less resistance from the spring 13 than when advancing against it). If feed nut 2 and worm 18 are rotated at the same time the movement amount of feed shaft 1 will be an algebraic sum of the movement corresponding respectively to the rotation of feed nut 2 and worm 18.

Figure 3:
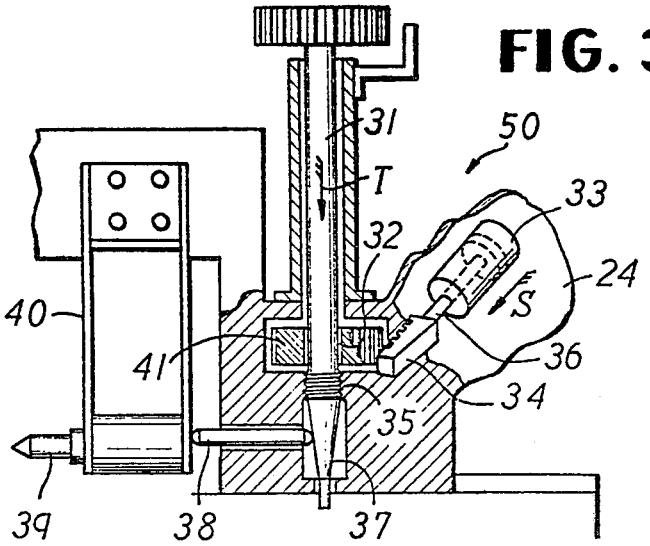
FIG. 3 is a schematic illustrative view, partly broken away and partly in section, of a dresser point compensation mechanism.

The dresser point compensation mechanism illustrated in FIG. 3 will be herein described in detail. As set forth before the pointed-end position of the dresser 39 plays an important role in securing precise final dimension of finished workpieces, nevertheless wear of the point due to dressing and subsequent gradual change of position of the point as well as the actual position change of the point due to deflection of the wheel spindle are unavoilable problems. It is this dresser point compensating mechanism that attempts to compensate the minute wear of the pointed-end of the dresser (hereinafter referred to simply as dresser point). This mechanism mounted on the carriage 24, comprises a piston rod 36 slidably disposed in a cylinder 33, a rack 34 secured to the outer end of rod 36, a pinion 41 which is engaged with rack 34, a shaft 31 to which pinion 41 is connected through the intermediary of a one-way clutch 32 (a clutch which is allowed to rotate in one direction only). As the shaft 31 is threadedly engaged with the carriage 24 at the thread portion 35, the rotation of pinion 41 displaces shaft 31 in the direction of the arrow T in FIG. 3 while rotating the same. A tapered portion is formed at the front end of shaft 31, against which one end of a push rod 38 is abutted; the other end of rod 38 is abutted against a pair of spring plates 40 parallel to the carriage 24. The dresser 39 is carried by a pair of springs 40 in a manner capable of minute axial displacement. Therefore, movement of piston rod 36 in the direction of the arrow S actuates a rotating and advancing movement of shaft 31, which leads to pushing out of dresser 39, i.e., compensation of the dresser point, through the intermediary of rod 38 which is in abutment with the tapered portion 37 of shaft 31 and the spring 40. Importance resides in this instance, however, not in the construction of the pushing out mechanism but in the timing of the operation and automation thereof and furthermore in the advantage of preventing shortage of sparkout grinding, i.e., preventing occurrence of inferior pieces ground.

Figure 4:
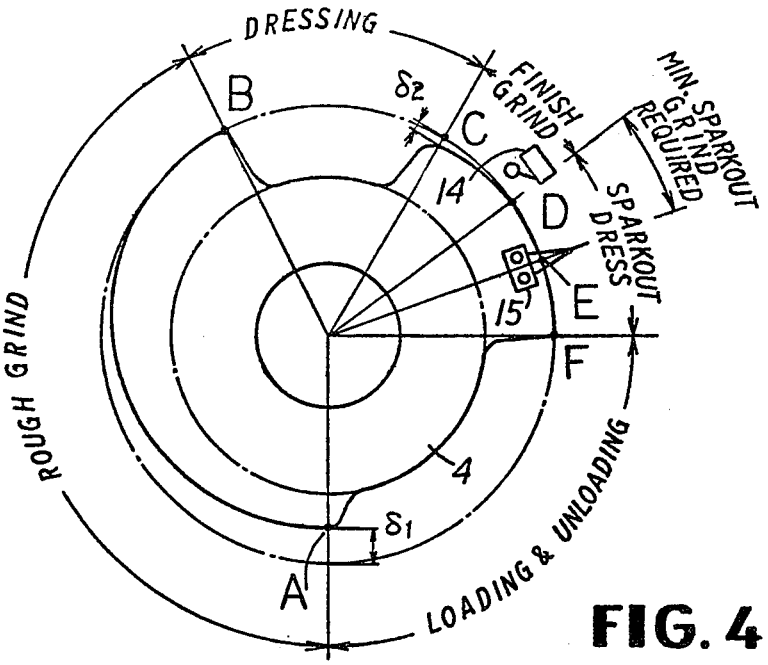
FIG. 4 is a view showing a profile of an abrasion wheel feed cam.

FIG. 4 indicates a cam 4 for controlling a complete grinding cycle, by whose profile each sequential step of rough grind, dressing, finish grind, and sparkout is programmatically controlled in the order. A sparkout time is indicated on the cam as an arc with a constant radius; it means a certain period of time elapsing in which the wheel continues grinding by a pressing force due to deflection of the wheel spindle. This continuation of grinding (hereinafter simply referred to as sparkout grind) is essential of obtaining a fine finish surface. For watching a certain minimum sparkout grind time are mounted a dog 15 on said arc portion of cam 4 at an adjustable position, and a limit switch 14, for the purpose of issuing a watching signal through contact with the dog 15, fixed on the bed 25 confronting therewith. In FIG. 4, $\delta$, indicates an amount of cam lift in the rough grind and $\delta_z$ also an amount of cam lift in the finish grind. In practice, however, said limit switch 14 may preferably be moved in lieu of moving dog 15 for adjustment so as to maintain the said relative position, because this method is easier to carry out.

Function of this embodiment will be described hereinunder in detail. In FIGS. 1 to 4, when wheel feed cam 4 is driven to rotate by a motor 70, then lever 3 is oscillated to depress push rod 10, and in turn, rotatively moves feed nut 2 through pre-compressed spring 13 and cylindrical member 10', feed shaft 1 which is threadedly engaged with feed nut 2 is moved in the direction of the arrow Y, and consequently the carriage 24 is also moved along the guide means 26, 26' in the direction of the arrow Y. In a similar way a workpiece W held by chuck 30 which is rotatably disposed on the workhead (not shown) mounted on the carriage 24 is also moved. By means of these movements, the wheel 28 can carry out the wheel feed movement against the workpiece W.

A series of movements comprising oscillation of lever 8 engaged with cam 9 which is synchronously rotated with cam 4, displacement of rod 7, rotation of claw clutch 6, dresser feed shaft 5, worm 18, and wormwheel 19 (i.e., operation of dresser feed mechanism 23) rotates feed shaft 1 and subsequently dresser 39 dresses out more than the wear amount of the external diameter of wheel 28 during the rough grind process. Since this dressing process is carried out after the rough grind process and before the finish grind process, the wheel 28 worn in the rough grind step enters the finish grind step in a status wherein its relative position with the workpiece W is fully compensated.

During each process of grinding set by cam 4, at least in the sparkout step, final size measuring means 27 is to measure the dimension of the ground workpiece W and when the size measured has reached the target dimension the final dimension signal will be issued from said means. As final size measuring means 27 any well-known suitable measuring means such as a differential transformer, an air micrometer, etc., may be employed. Said final dimension signal actuates the piston in cylinder 11 in a conventional way (no shown), and piston rod 12 acts on the projection **2*a* of feed nut 2 for rotating the nut in the reverse direction to that of wheel feed while compressing the spring 13 in cylindrical member 10'. In other words, it separates the wheel 28** from the workpiece W and interrupts even the ensuring sparkout grind so as to seek any time a coincidence of the processed dimension of the workpiece W with the target dimension.

The moment at which the final size measuring means issues the final dimension signal is, of course, the point of time when the processed dimension of the workpiece W has reached the target dimension. That point should be, referring to the process profile of FIG. 4, after the completion of the minimum required sparkout grind necessary for improving smoothness of workpiece surface processed.

In a control by means of wheel feed cam 4 the sparkout grind is a process taking place while the cam is being kept in the largest lift profile, so that even in case a processed dimension has not reached the target dimension during the period the wheel 28 will be separated from the workpiece W due to its quick return motion caused by a sudden drop of the cam lift and will enter a loading and unloading process. Then a workpiece W of too small bore diameter will be produced. It is, therefore, required that in an adjustment of a grinding machine of final dimension signal from the final size measuring means 27 shall be so adjusted as to be issued after the completion of sparkout grind and before the sudden drop of the cam lift.

If a dog 15 for watching sparkout grind is set at a point where a minimum required amount of sparkout grind is completed, it is necessary that a sparkout watching signal is at first issued by means of limit switch 14 then a final dimension signal is issued from the final size measuring means 27 and thereafter occurs a sudden drop of the cam lift, i.e., returning operation of push rod 10 and lever 3. If this order is not duly kept it will naturally cause a production of inferior pieces ground; and the greatest possible cause of making this disorder is the very wear of the pointed-end of the dresser.

Figure 5:
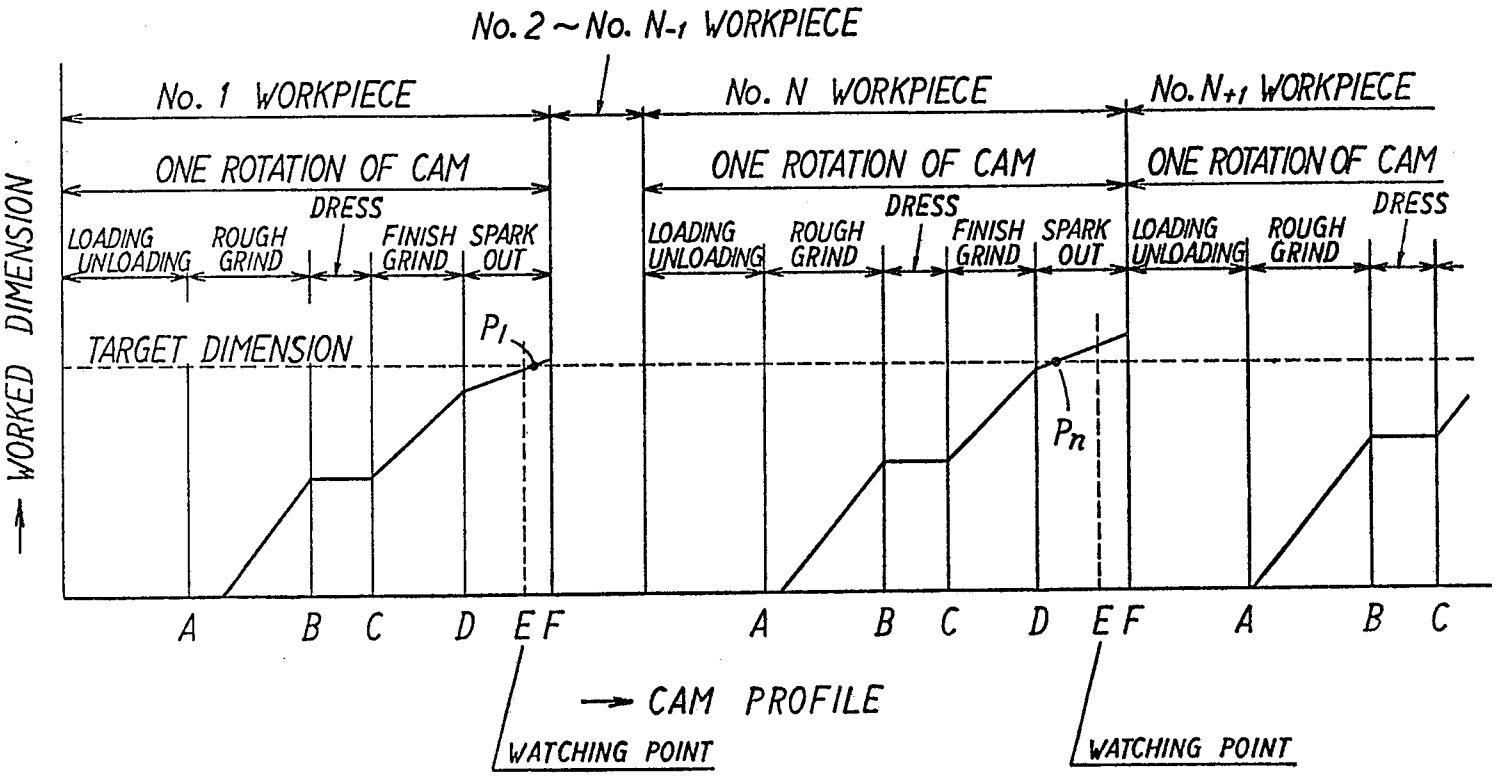
FIG. 5 is a graph indicating progressive dimensional change of a workpiece corresponding to the cam profile.

Referring to FIG. 5, in the left half of same the portion of the first workpiece (the first cycle of grinding) shows the relation between a process under an exactly adjusted profile as above-mentioned and a processed dimension of a workpiece W. It can be seen that point $P_1$, denoting a final dimension signal, is located after point E which shows a sparkout watching point, and before the completion of sparkout process.

Assuming a case wherein the dresser point has been gradually worn by repeated dressings, a dressing shortage may occur all over the external diameter of the dresser 28 as much as the accumulated wear, which will lead to too large worked-dimension shown in the right half of FIG. 5, the Nth workpiece (the Nth cycle of grinding). Point $P_n$, denoting a final dimension signal, is moved up prior to point E. As the final dimension signal point is just the instance when the wheel 28 leaves the workpiece, it means that grinding process ceases before the completion of necessary sparkout grinding, so it leaves much chance of producing inferior pieces whose surface have not been sufficiently well finished in spite of having been processed to the target dimension. With the object of eliminating this trouble a dresser point compensation mechanism 50 shall be actuated by means of a device sensing a premature issue of a final dimension signal prior to a sparkout watching signal (a device well-known such as a relay may be used, not shown); that is to say, dresser 39 is minutely advanced by the actuation of cylinder 33 for the purpose of compensating the wear amount of the dresser point. This is a certain preset amount, which enables a workpiece to be ground to a fine final dimension on the surface thereof and further a plurality of successive workpieces are to be ground similarly in good condition.

Another embodiment capable of automatic compensation for the point wear of a dresser will be described in detail referring to FIG. 6, a block diagram illustrating the mechanism. In this case a dog 15 is set at the starting point of sparkout; by means of a sparkout starting signal issued by operation of limit switch 14 a timer 47 (set time is adjustable) is initiated to actuate; and a timeout signal from this timer 47 which is set at the minimum required sparkout grind time and a final dimension signal from the final size measuring means 27 are introduced into a comparison judgement device 48 (a well-known suitable device may be applied) respectively as an input so as to electrically or electronically judge by comparison of the timing of two signals. So long as a timeout input of timer 47 leads the final dimension signal input, the dresser point compensating mechanism 50 shall be prevented from actuation. On the contrary, when the timeout signal of the timer 47 lags behind the final dimension signal input, the dresser point compensating mechanism 50 shall be actuated for performing the automatic compensation for the wear of the dresser point.

Figure 6:
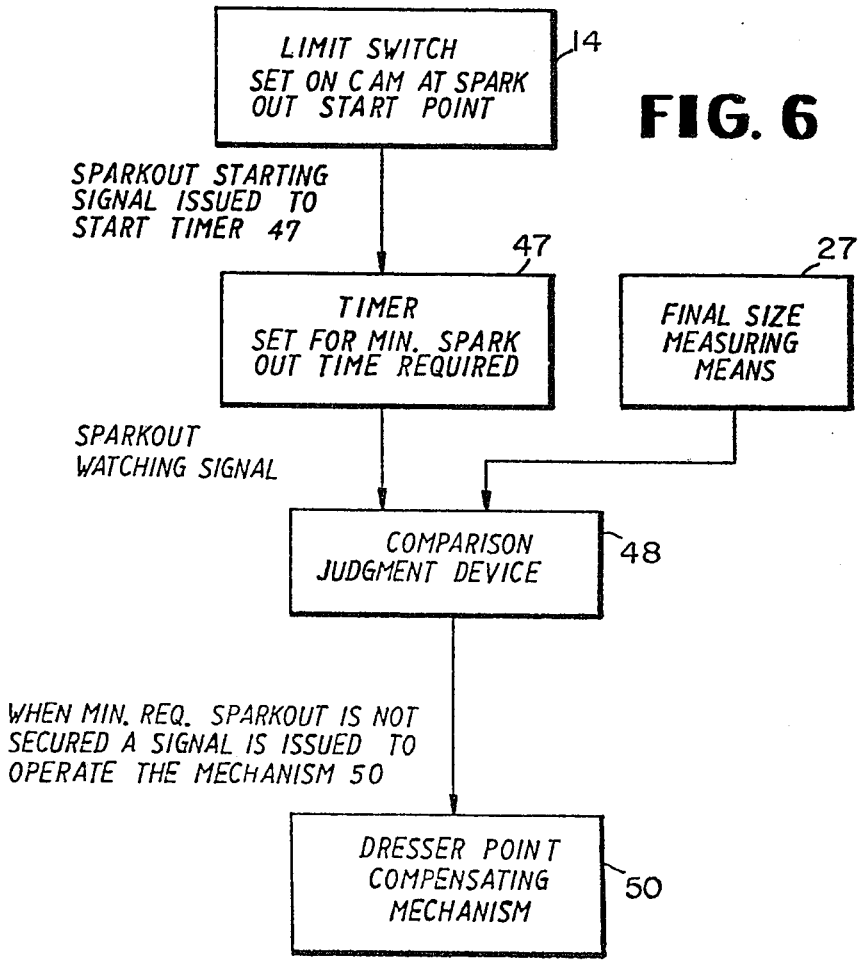
FIG. 6 is a block diagram for illustrating the essential part of another embodiment.

The embodiment illustrated in FIG. 6 has a strong point in that the minimum required sparkout grinding time can be secured by merely adjusting a timer 47. Comparing it with the conventional method wherein operators have had to empirically compensate for wear of the dresser point taking many complex conditions into consideration such as material quality of workpieces, finish dimensions of workpieces, wheel diameters, composition of wheels and revolution speed of workpieces, etc., there is no need to dwell upon the effects of this embodiment.

Although the above description of each embodiment was concerned about an internal grinding machine as well as an internal grinding method, it can be, of course, applicable to an external grinding machine and method.

Effects of the present invention described in detail above may be summarized as follows: (1) adding an "in process" constant dimension measuring mechanism onto a cam-controlled grinding machine based on the sizematic system of high speed cycle and of high productivity, and introducing advantages of the gagematic system which is capable of securing final constant dimension of workpieces; (2) securing the minimum required sparkout grind time in order to maintain good finish surface of workpieces; (3) succeeding in automatically performing the compensation for wear of the dresser point, a very hard task, by means of comparing the final dimension signal with the minimum required sparkout grind time; (4) achieving materialization of the above object by means of a rather simple device, which provided not a few merits such as simplification and facilitation of adjustment and so on; (5) another non-negligible advantage of this invention resides in that it can be readily added to or incorporated, with a partial modification, into a conventional cam-controlled grinding machine.

The invention having been thus described what is claimed as new and desired to secure by Letters Patent is:

1. In a cam-controlled grinding apparatus including a rotatable abrasive wheel mounted on the bed thereof and slidable in the axial direction of said wheel, a chuck, capable of holding a workpiece, disposed in confrontation with the abrasive wheel and rotatable about an axis substantially parallel to the wheel axis and furthermore movable in a direction normal to the wheel axis, a wheel feed mechanism for controlling the relative movement between said workpiece and said wheel by means of a cam, a dresser, including a dresser point, for dressing said wheel, and a dresser feed mechanism, the improvement of said grinding apparatus comprising:

measuring means for measuring a dimension of the workpiece processed while grinding is taking place;

final dimension signal means for issuing a final dimension signal as soon as the dimension measured by said measuring means has reached a predetermined target dimension;

release means for separating the wheel from the workpiece in response to said final dimension signal;

watching means for determining when sparkout grinding has proceeded for a predetermined period of time and for issuing a sparkout signal when said predetermined period of time has elapsed;

comparison signal means for issuing a comparison signal in response to the comparison of the timing between said final dimension signal and said sparkout signal whenever said final dimension signal precedes said sparkout signal; and compensating means for compensating wear of said dresser point upon issuance of said comparison signal.

2. A cam-controlled grinding apparatus in accordance with claim 1 wherein said watching means comprises:

a dog disposed on the cam; and a limit switch mounted on the bed, actuatable by said dog, for issuing said sparkout signal upon actuation by said dog, wherein the position of said dog and said limit switch are arranged such that said limit switch is actuated by said dog after said predetermined minimum sparkout time has elapsed and wherein the relative position of said bog and said limit switch is adjustable.

3. A cam-controlled grinding apparatus in accordance with claim 1 wherein said watching means comprises;

a dog disposed on the cam;

a limit switch mounted on the bed actuatable by said dog, wherein the position of said dog and said limit switch are arranged such that limit switch is actuated by said dog at the beginning of the sparkout time; and a timer, actuatable upon actuation of said limit switch, for adjustably setting the minimum required sparkout grinding time and for issuing said sparkout signal after the predetermined minimum sparkout time set on the timer has elapsed.

* * * * *

UNITED STATES PATENT AND TRADEMARK OFFICE

CERTIFICATE OF CORRECTION

PATENT NO. : 4,045,920

DATED : September 6, 1977

INVENTOR(S) : FUKUMA et al.

It is certified that error appears in the above-identified patent and that said Letters Patent are hereby corrected as shown below:

Abstract, line 1, delete " "sizematic" " and insert therefor --"mechanism size control"-- line 3, delete " "gagematic" " and insert therefor --"gaging size control"--

Column 1, lines 14, 29 and 39; column 3, lines 27 and 31; and column 10, line 14, delete "gagematic" and insert --gaging size control--

Column 1, lines 15, 29, 38, 43, 48 and 49; column 2, lines 37 and 44; column 3, lines 2 and 29; and column 10, line 13, delete "sizematic" and insert --mechanism size control --

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*